US007025237B2

(12) United States Patent
Herold

(10) Patent No.: US 7,025,237 B2
(45) Date of Patent: Apr. 11, 2006

(54) MODULAR DUAL SHOULDER STRAP FOR GOLF CLUB BAGS

(75) Inventor: Jeffrey Herold, Huntington Beach, CA (US)

(73) Assignee: West Coast Trends, Inc., Huntington Beach, CA (US)

( * ) Notice: Subject to any disclaimer, the term of this patent is extended or adjusted under 35 U.S.C. 154(b) by 44 days.

(21) Appl. No.: 10/352,523

(22) Filed: Jan. 28, 2003

(65) Prior Publication Data

US 2004/0144820 A1 Jul. 29, 2004

(51) Int. Cl.
*A45C 15/00* (2006.01)

(52) U.S. Cl. ..... 224/579; 224/264; 224/627; 224/643

(58) Field of Classification Search ..... 224/264, 224/259–260, 627, 642–643, 645, 578, 579; 206/315.3

See application file for complete search history.

(56) References Cited

U.S. PATENT DOCUMENTS

| | | | | | |
|---|---|---|---|---|---|
| D275,153 | S | * | 8/1984 | Weinreb | D3/327 |
| 4,879,768 | A | * | 11/1989 | McClees et al. | 224/264 |
| 4,887,318 | A | * | 12/1989 | Weinreb | 2/268 |
| 4,978,044 | A | * | 12/1990 | Silver | 224/264 |
| 5,038,984 | A | | 8/1991 | Izzo | |
| 5,042,703 | A | | 8/1991 | Izzo | |
| 5,042,704 | A | | 8/1991 | Izzo | |
| 5,566,871 | A | * | 10/1996 | Weintraub | 224/264 |
| 5,593,077 | A | | 1/1997 | Izzo | |
| 5,636,778 | A | | 6/1997 | Jones et al. | |
| 5,803,792 | A | * | 9/1998 | Roush et al. | 2/268 |
| D411,039 | S | | 6/1999 | Reimers et al. | |
| 5,988,475 | A | | 11/1999 | Han | |
| 6,006,974 | A | * | 12/1999 | Varney et al. | 224/645 |
| 6,305,535 | B1 | * | 10/2001 | Fair | 206/315.3 |
| 6,354,477 | B1 | * | 3/2002 | Trummer | 224/578 |
| 6,467,661 | B1 | * | 10/2002 | Mistretta et al. | 224/264 |
| 2001/0003344 | A1 | * | 6/2001 | Jarman | 224/645 |
| 2003/0121942 | A1 | * | 7/2003 | Chang | 224/260 |

OTHER PUBLICATIONS

Copy of International Search Report corresponding to International application No. PCT/US04/01981 dated Dec. 29, 2004.

* cited by examiner

*Primary Examiner*—Stephen K. Cronin
(74) *Attorney, Agent, or Firm*—Thelen Reid & Priest LLP

(57) ABSTRACT

A modular system for a golf club bag shoulder strap arrangement has been discovered and is presented here. It includes sub-elements of four primary types. A single point fastener end, a two-to-one 'V' connector, a main padded strap, and a connection loop. Each of these elements couples in a special manner to appropriate cooperating sub-elements and may be easily decoupled for replacement, repair, resizing, et cetera. The coupling-decoupling function is indented to be quick, temporary, and replaceable in nature. Thus, these dual straps are provided with functionality not found in similar and competing systems.

13 Claims, 4 Drawing Sheets

MODULAR DUAL SHOULDER STRAP FOR GOLF CLUB BAGS

BACKGROUND OF THESE INVENTIONS

1. Field

The following invention disclosure is generally concerned with golf accessories and specifically concerned with modular shoulder straps for golf club bags.

2. Prior Art

Shoulder straps for golf club bags are the subject of several useful inventions and corresponding patents. For example, U.S. design Pat. No. D411,039 illustrates a nice arrangement of strap elements to form an attractive harness system. More directly, inventors Jones et al, apply a specific arrangement of cooperating elements to form a highly functional double strap system in U.S. Pat. No. 5,636,778. Still further, Han teaches in U.S. Pat. No. 5,988,475 special systems to accommodate the function of holding a golf club bag to the center of a users back thus providing for a more balanced load. A most interesting arrangement is also described in disclosure numbered as U.S. Pat. No. 5,593,077 by Ted Izzo of Evergreen, Colo. This excellent system provides some very useful functionality relating to the holding of golf club bags in cooperation with a users' anatomy.

While the systems and inventions of the art are designed to achieve particular goals and objectives, some of those being no less than remarkable, these inventions have limitations which prevent their use in new ways now possible. Inventions of the art are not used and cannot be used to realize the advantages and objectives of the present invention.

SUMMARY OF THESE INVENTIONS

Comes now, Jeffrey Herold with inventions of straps for golf club bags including those having a highly modular nature. It is a primary function of these inventions to provide advanced functionality to golf club bag straps. More particularly with regard to fit, load, fashion and service, modularity operates to provide a golf club bag straps adjustments and function not available in similar designs.

Apparatus of these inventions primarily include a dual strap arrangement with three connection points. Three connection fasteners, a junction element, and two elongated pad/strap elements are combined with a supplemental pad to from a best version. The junction element joins each of two elongated pad/strap elements to a first connection fastener. Additional connection fasteners each affixed to an opposing end of elongated pad/strap elements form a 'V' shaped three-point attachment configuration.

OBJECTIVES OF THESE INVENTIONS

It is a primary object of these inventions to provide straps for golf club bags with improved function.

It is an object of these inventions to provide shoulder straps for golf club bags.

It is a further object to provide ergonomically superior shoulder straps for golf club bags.

It is further an object to provide shoulder straps for golf club bags which have interchangeable parts for easy configuration change and easy repair.

A better understanding can be had with reference to detailed description of preferred embodiments and with reference to appended drawings. Embodiments presented are particular ways to realize the invention and are not inclusive of all ways possible. Therefore, there may exist embodiments that do not deviate from the spirit and scope of this disclosure as set forth by the claims, but do not appear here as specific examples. It will be appreciated that a great plurality of alternative versions are possible.

BRIEF DESCRIPTION OF DRAWING FIGURES

These and other features, aspects, and advantages of the present invention will become better understood with regard to the following description, appended claims and drawings where:

PREFERRED EMBODIMENTS OF THESE INVENTIONS

Figure 1:
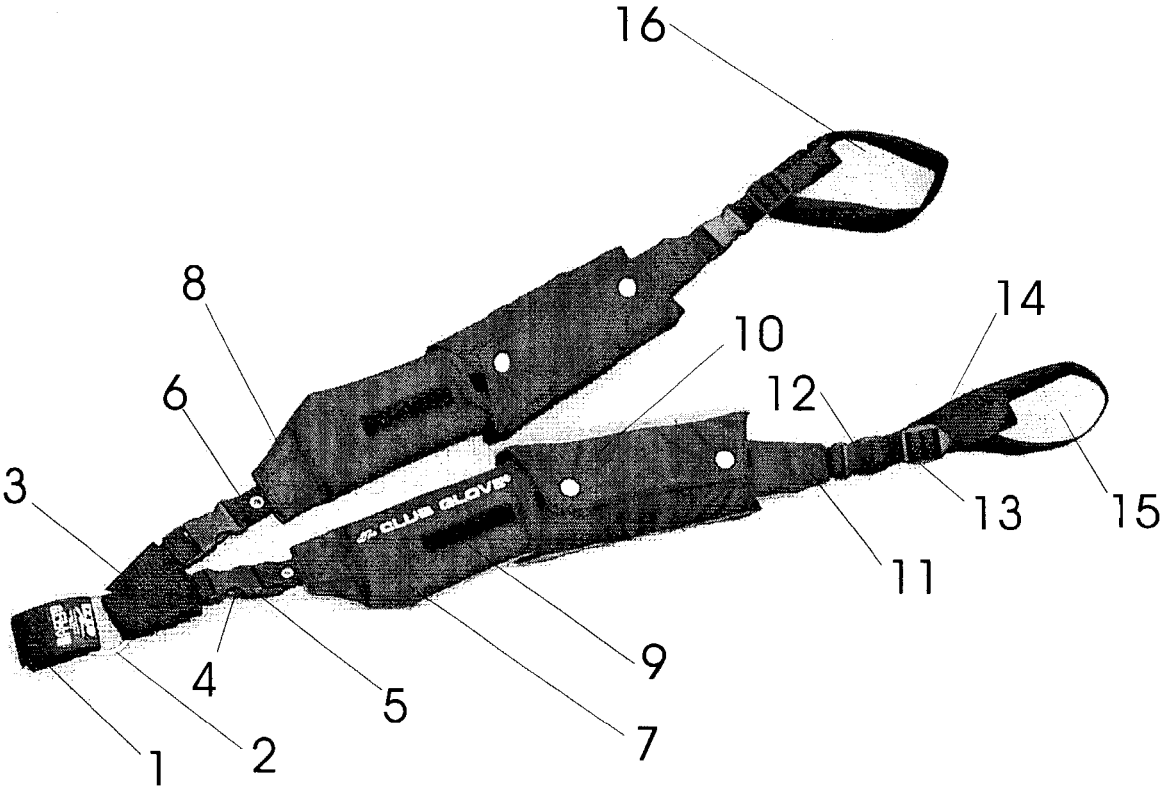
FIG. 1 is a first version of a dual strap of these inventions.

In accordance with each of the preferred embodiments of these inventions, there are provided modular dual shoulder straps for golf club bags. It will be appreciated that each of these embodiments described include an apparatus and that the apparatus of one preferred embodiment may be different than the apparatus of another embodiment.

Shoulder straps used in conjunction with golf club bags are typically integrated with the bags. Designers of golf club bags include as a permanent part of the bag article a shoulder strap element. As such, these straps are limited in their functionality and usefulness. Limitation with regard to fit, load, fashion, serviceability among others may be found with common integrated straps used in conjunction with everyday golf bags. Notably, these straps are configured with a 'one size fits all' strategy. Unfortunately, this results in mediocre results for most users. Thus, the fit is relatively 'fixed' and not readily adjustable. While some high quality straps allow for minor adjustments of strap length, this is a small consideration. Since fully loaded golf club bags present considerable loads to most golfers, it is desirable to provide the very best possible ergonomic cooperation between the bag and the golfer. Additionally, golf club bags may be used with various degrees of loads from time-to-time. On any given day, a load to be carried in a golf bag may be considerably less than the load carried on another day. Thus, it is useful to correspondingly adjust strap components in order to provide function in agreement with load. Frequently, golfers prefer a fashionable look which may only be attained with the highest quality products. As fashions change in time, a golf bag and associated strap may include features which permit updated fashion or appearance. Finally, serviceability is improved where components can receive attention independent of one another. Advantage is realized in shipping and turnaround time where one piece may be exchanged for another, or one repaired. To achieve these goals among others, the following special shoulder straps have been invented, designed and configured.

It has been found that preferred shoulder strap arrangements for golf club bags includes a dual strap, or double strap design. A heavy load is distributed over a greater area with dual strap systems compared to single strap devices which tend to focus pressure in a single small region and 'dig' into the top of a carrying shoulder. Dual straps have been proposed in several configurations by various inventors. A dual strap of particular interest with respect to these inventions include a dual strap design having a three-point attachment arrangement. In example, the strap system forms a 'V' shaped apparatus which may be affixed to a golf club bag at three different points. This may have been first elegantly presented by Izzo in U.S. Pat. No. 5,593,077. Improvements to this foundation concept now have been applied to result in apparatus described here following.

A first major design consideration includes a notion of modularity. By configuring a dual strap system comprised of a plurality of sub systems or sub elements in a manner whereby the sub elements may be easily removed from one another and replaced with cooperating parts provides significant advantage over the systems of the art. Dual strap systems of these inventions may be comprised primarily of four elements including: connection fasteners; a junction element; and two elongated padded straps, adjustable broad pad elements. When assembled together, these elements form very nice straps particularly useful in conjunction with golf club bags.

Fit

Fit is a most important extended function which results from having a highly modular system. Some golfers have very broad shoulders while others quite narrow. It in not the case that a single size or shape pad will cooperate with the shoulders of all people, but rather, each person's body type tends to demand a different pad system appropriate for that body type.

A very large, bulky and soft pad may ergonomically accommodate a large shoulder better than a thin one. Similarly, a firm slight pad might better couple with a slim shoulder. The shoulder straps of these inventions are arranged such that golfers of both these body types will be able to change the padding strategy in accordance with the precise ergonomic factors to best fit individual golfers. This is possible because these straps are arranged in modular fashion whereby at least one of the modules is a supplemental pad element. A supplemental pad may be coupled to a primary pad strap element via removable fasteners. In this way, a 'standard' supplemental pad may be removed from the strap system and replaced by a specialized supplemental pad thus providing a preferred fit. Golf club bags having straps which do not include removable pads force a golfer to use a pad of a inappropriate size.

The paragraph above is directed to the importance of size fitting. However, proper fitting also includes padding position adjustments. A very important aspect of these straps systems is that certain pad elements are highly adjustable in position. A supplemental pad may be moved up or down a longitudinal or elongated strap element and further coupled therewith in a fixed position which is desirable for a specific person. This is possible by way of a fastener system applied in anticipation of this function. Where previous strap systems included a bit of modularity, i.e. straps with at least some removable fasteners, those systems have not presented the fasteners in conjunction with position adjustment function.

Load

Load accommodation functionality is extended when strap elements may be interchanged for heavy/light duty elements for use in conjunction with corresponding loads. An elongated strap/pad element may be made with various degrees of strength, i.e. via differing gauges of materials, whereby the strap/pad element is appropriate for various loads. The elongated strap/pad element portion of the system then can be switched out with another element more appropriate for a specific load. In this way, a strap system effectively adapts in agreement with the anticipated service of the bag from day-to-day. Where a golfer plans to play a quick 9 with minimal equipment, she might choose to configure the bag strap with the lightest version of an elongated strap/pad member. Where a full day's play includes carrying lunch or refreshments, heavy equipment, telephone, rain gear, et cetera, a bag may become very heavily loaded and demand use of a thicker, more durable strap/pad element.

Fashion

Fashion is also an important function which is extended via the modularity of a golf club bag strap system. While typical straps are made with a neutral black or gray colored material so they will match any colored bag, modular systems may include components of various colors which may be switched from time-to-time in agreement with aesthetic demands. When a golfer desires a bit extra brightness in the springtime, brightly colored elements may be exchanged for black colored elements. In addition, strap elements having event specific logos thereon might be interchanged with neutral elements. Golfer members of a team such as a college sports team can all join in a uniform effort to display a team mascot color scheme by way of changing strap components in agreement therewith. Thus, a highly modular golf club bag strap systems improves ones ability to manage fashions important to the game.

Service

Modularity of strap systems also provides for improvements in the serviceability of these devices. In normal use, the strap of a golf bag may become subject to damage via wear or accident. As such, it may require repair attention. Where repair is necessary, a specific component can be switched out and shipped to a repair facility for easy repair without having to ship the entire bag or even the entire strap. A replacement component can be pre-shipped to a user in order that the strap is not out of service for any appreciable time. It is unlikely that a manufacture would like to incur the expense of shipping an entire system on loan during repairs, however, to ship a single element becomes quite attractive.

While straps of typical bags may be tightly integrated, the straps presented here are highly modular. These straps may be taken apart at several different places so that any element needing service may be separately addressed. It is easy for a user to send a single strap element to the manufacture for quick turn around and minimal loss of bag service. This avoids the necessity of shipping an entire bag which may be accompanied by considerable delay.

These examples and advantages described above are directed to specific embodiments which illustrate preferred versions of devices and methods of the invention. In the interests of completeness, a more general description of devices and the elements of which they are comprised as well as methods and the steps of which they are comprised is presented here following.

Apparatus of these Inventions

In most general terms, apparatus of these inventions may precisely be described as including modular dual strap systems for golf club bags including connection fasteners (typically three), a junction element, and two elongated pad/strap elements. The junction element joins each of said elongated pad/strap elements to a first connection fastener. Second and third of connection fastener each may be affixed to an opposing end of said elongated pad/strap elements whereby a 'V' shaped three-point attachment configuration is formed.

With reference to the drawing figures, one gains a more firm appreciation of these elements and their relationship to the others. In drawing FIG. 1, a first connection element is presented as 1. This may be preferably formed of a strip of high strength nylon webbing material to form a loop which may be fastened, taken apart, and refastened. In best systems, this connection element includes Velcro fasteners which are easy to operate, durable, and long lasting. Alternatives may include snap systems or other mechanical interlocking fasteners.

A metallic ring element 2 is sometimes used to couple the connection fastener to a wishbone junction element. The action of the bag to be supported with respect to shoulder straps firmly in place on a user demands a bit of freedom of motion while a golfer walks. Thus the metallic ring provides a strong coupling while simultaneously providing non-binding motion action between strap components.

Wishbone junction element 3 divides the strap system into two parallel members. The wishbone junction element is coupled to and removably affixed to elongated pad/strap elements by way of two-part male 4 and female 5 plastic buckle. Either pad/strap element may be removed independently from the wishbone junction element.

An elongated pad/strap element is comprised of Nylon webbing and foam pad portions. A webbing portion 6 is permanently affixed to a pad portion 7 via a sewn joint 8 at a first end of the pad/strap element. The pad may additionally have, on its exterior, a fastener element 9. This fastener is arranged to cooperate with a supplemental pad 10. Another end of the pad/strap element 11 is similarly affixed and coupled via another buckle fastener 12. Another connection fastener may be formed with a friction clip 13 which holds two ends of a webbing strip 14 to form a loop 15. Similarly on the other branch of the dual strap system, a connection fastener is formed of loop 16.

Figure 2:
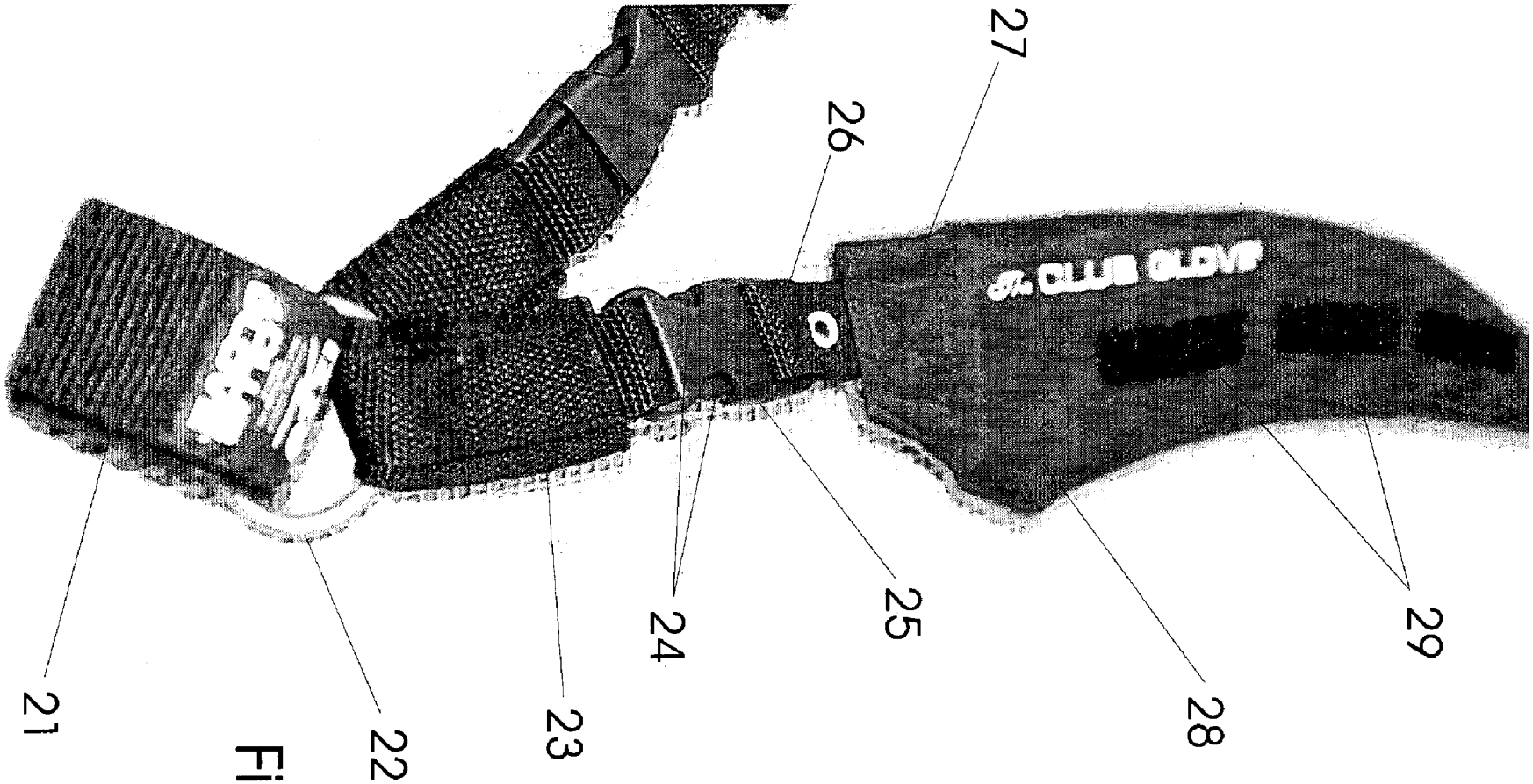
FIG. 2 illustrates an important coupling portion of a golf club strap element.

It is useful to consider these elements in more detail. FIG. 2 is provided to show more clearly the wishbone junction region and related elements of the system. Connection fastener 21 is a loop of webbing having a Velcro joint. Metal ring 22 connects to wishbone junction element 23 in a sliding fashion to provide a moving joint which is permanent. The metal ring is not intended to be removed from the wishbone. Two-part male female buckle 24 and 25 connect the wishbone to the elongated pad/strap element webbing portion 26, further by way of sewn joint 27 to pad portion 28. Hook and loop fastener strips 29 are affixed to the topside surface of the pad as shown.

Figure 3:
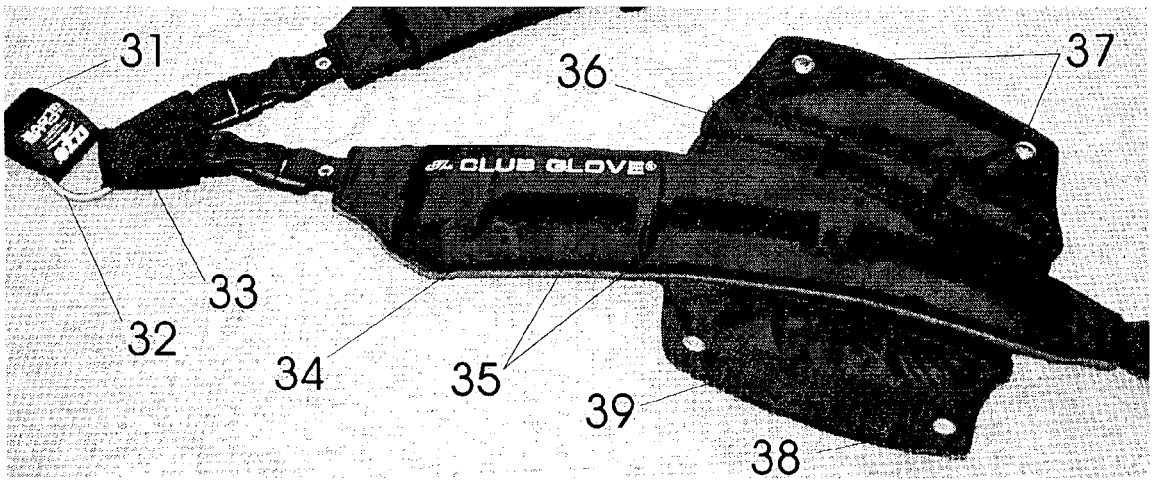
FIG. 3 shows a single branch of a dual strap including a special adjustable pad element.

FIG. 3 additionally shows one branch of the dual strap in isolation where connection fastener 31 is looped about metal ring 32. The ring is permanently sewn into the wishbone 33. The elongated pad/strap 34 is shown with hook and loop fasteners 35 thereon. Supplemental pad 36 having snap elements 37 and cooperating snaps 38 arranged as shown, may be wrapped about the pad/strap element to provide improved pad function. The supplemental pad may be positioned at any point along the length of the pad/strap element to provide a best fit. Hook and loop fastener 39 also helps to join the supplemental pad to the pad/strap element.

Figure 4:
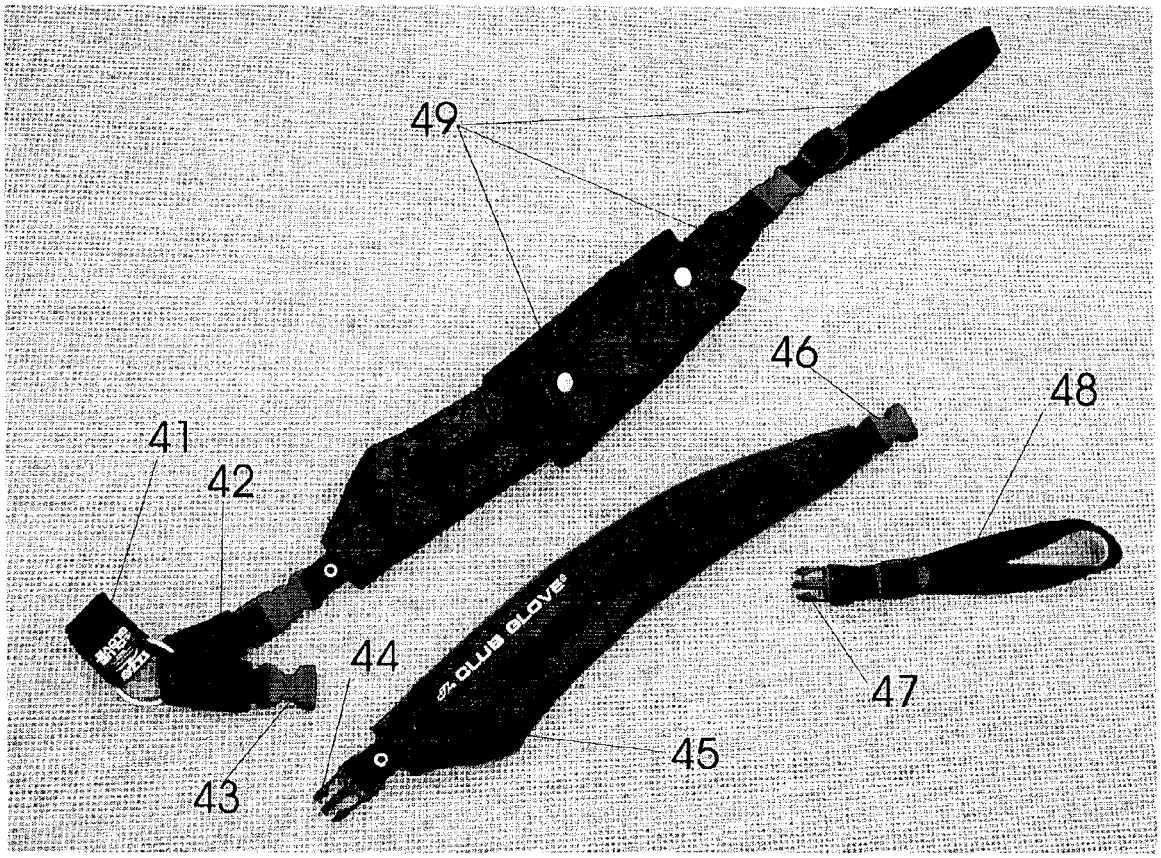
FIG. 4 is an exploded view of a version of a dual strap for golf bags.

In an exploded view, FIG. 4 shows the elements decoupled from one another. Connection element 41 connected to wishbone junction element 42 has a buckle portion 43 thereon. A cooperating buckle portion 44 is at one end of a pad/strap element 45 while having a similar but opposite buckle 46 at the other end. Another buckle portion 47 is a component of connection fastener 48 which is formed of a loop of webbing material. When assembled together, these parts 49 form a luxury strap system highly effective and functional.

One will now fully appreciate how high performance dual strap systems for golf club bags may be realized. Although the present invention has been described in considerable detail with clear and concise language and with reference to certain preferred versions thereof including the best mode anticipated by the inventor, other versions are possible. Therefore, the spirit and scope of the invention should not be limited by the description of the preferred versions contained therein, but rather by the claims appended hereto.

What is claimed is:

1. Modular dual straps for golf club bags comprising:

a first elongated pad/strap element having a first end and a second end, said first end having a first female buckle element and said second end having first male buckle element;

a second elongated pad/strap element having a first end and a second end, said first end having a second male buckle element and said second end having a second female buckle element;

a junction element designed to slideably join each of the elongated pad/strap elements, said junction element having a first side having a third male buckle element to removably mate with said first female buckle element of the first pad/strap element and a second side having a third female buckle element to removably mate with said second male buckle element of the second pad/strap element;

a first connection fastener having a fourth female buckle element to removably mate with said first male buckle element; and a second connection fastener having a fourth male buckle element to removably mate with said second female buckle element.

2. The straps of claim 1, wherein each of said elongated pad/strap elements further comprise a position adjustable affixing means.

3. The straps of claim 1, wherein said first and second connection fasteners include two loop type connection fasteners, each fastener formed of Nylon webbing.

4. The straps of claim 1, further comprising a junction linking fastener coupled to said junction element via a metal ring to provide arcuate freedom of motion there between.

5. The straps of claim 1, wherein the male and female buckle elements between the elongated pad/straps elements and junction element includes removable and refastenable type fasteners.

6. The straps of claim 1, wherein the male and female buckle elements between the elongated pad/strap elements and first and second connection fasteners are removable and refastenable type fasteners.

7. The straps of claim 1, wherein the first and second connection fasteners are nylon webbing held together with a friction clip.

8. The straps of claim 1, further comprising a metal ring coupled between the junction element and a third connection fasteners.

9. The straps of claim 1, further comprising:

two supplemental pads, each operable for being coupled with either of said elongated pad/strap elements.

10. The straps of claim 9, wherein said supplemental pads are circumferentially coupled to said pad/strap elements.

11. The straps of claim 9, wherein said supplemental pads further comprise snap fasteners arranged to permit a circumferential fit about a pad/strap element.

12. The straps of claim 9, wherein each of said elongated pad/straps and supplemental pads have complementary fastener elements which permit longitudinal position adjustments.

13. The straps of claim 12, wherein said complementary fastener elements are hook and loop type fasteners.

* * * * *